United States Patent [19]

Distelrath et al.

[11] Patent Number: 5,050,566

[45] Date of Patent: Sep. 24, 1991

[54] FLOW DUCT FOR AN INTERNAL COMBUSTION ENGINE

[75] Inventors: Winfried Distelrath, Stuttgart; Roland-Dieter Zebli, Wurmberg, both of Fed. Rep. of Germany

[73] Assignee: Dr. Ing. h.c.F. Porsche AG, Fed. Rep. of Germany

[21] Appl. No.: 554,896

[22] Filed: Jul. 20, 1990

[30] Foreign Application Priority Data

Jul. 25, 1989 [DE] Fed. Rep. of Germany ..... 3924544

[51] Int. Cl.[5] ..... F02M 35/10

[52] U.S. Cl. ..... 123/52 M; 123/188 M; 123/432

[58] Field of Search ..... 123/52 M, 52 MV, 52 MC, 123/52 MB, 52 MF, 188 M, 432, 308, 193 H

[56] References Cited

U.S. PATENT DOCUMENTS

| | | | |
|---|---|---|---|
| 3,270,733 | 9/1966 | Steidler | 123/188 M |
| 3,945,349 | 3/1976 | Elsbett et al. | 123/52 M |
| 4,069,796 | 1/1978 | Balsley | 123/52 M |
| 4,187,823 | 2/1980 | Brown | 123/52 M |
| 4,366,787 | 1/1983 | Gale | 123/188 M |
| 4,574,751 | 3/1986 | Sugiyama et al. | 123/52 M |
| 4,679,532 | 7/1987 | Aoi et al. | 123/308 |
| 4,719,879 | 1/1988 | Kato et al. | 123/52 M |
| 4,726,341 | 2/1988 | Muranaka et al. | 123/432 |
| 4,741,294 | 5/1988 | Yasuda et al. | 123/52 MV |
| 4,805,569 | 2/1989 | Suzumura et al. | 123/308 |
| 4,938,191 | 7/1990 | Oldani et al. | 123/308 |

FOREIGN PATENT DOCUMENTS

| | | | |
|---|---|---|---|
| 1476080 | 1/1972 | Fed. Rep. of Germany . | |
| 2122942 | 4/1980 | Fed. Rep. of Germany . | |
| 2922058 | 1/1984 | Fed. Rep. of Germany . | |
| 3518225 | 11/1985 | Fed. Rep. of Germany . | |
| 3508763 | 1/1986 | Fed. Rep. of Germany . | |
| 3510226 | 10/1986 | Fed. Rep. of Germany . | |
| 0124019 | 7/1983 | Japan | 123/308 |
| 0150025 | 9/1983 | Japan | 123/308 |
| 682450 | 11/1952 | United Kingdom . | |
| 881089 | 11/1961 | United Kingdom | 123/188 M |
| 2056553 | 3/1981 | United Kingdom | 123/188 M |

OTHER PUBLICATIONS

Mot Technik Seminar-pp. II & III, 12/1983, author unknown.

*Primary Examiner*—David A. Okonsky

*Attorney, Agent, or Firm*—Evenson, Wands, Edwards, Lenahan & McKeown

[57] ABSTRACT

A flow duct, particularly an intake duct in an intake system and a cylinder head of an internal-combustion engine has a defined flow profile by means of which the flow rate of the gas flow is accelerated continuously, specifically until it reaches a cross-sectional transition area of the intake duct which—viewed in the flow direction—is situated upstream of a valve stem. After that, the flow rate of the gas flow is reduced whereby a lower approach flow speed of the valve is achieved. This causes an optimized volumetric efficiency which has a favorable effect on the power and the consumption of the internal-combustion engine.

9 Claims, 3 Drawing Sheets

FLOW DUCT FOR AN INTERNAL COMBUSTION ENGINE

BACKGROUND AND SUMMARY OF THE INVENTION

The invention relates to a flow duct particularly an intake duct, in an intake system and a cylinder head of an internal-combustion engine, in which a gas flow is controlled by means of a valve which comprises a valve disk interacting with a valve seat and a valve stem which is connected with it and, in an axially movable manner, is disposed in a valve stem guide, the valve stem being arranged adjacent to the valve seat ring in the intake duct in such a manner that it is subjected to the gas flow.

In a known flow duct, described in German Patent Document DE-OS 35 08 763, the flow profile is designed such that it tapers continuously in the direction of the valve seat ring. This design is a result of the physical principle that the lowest losses, when the flow is unimpaired, occur in a flow duct if the cross section of the flow duct narrows down continuously and the velocity of the gas flow is increased continuously. However, in the case of a flow duct having a valve, an unimpaired flow cannot always be implemented because this valve causes a considerable flow resistance which, together with a flow profile of this type, impairs an optimized operation of an internal-combustion engine.

It is an object of the invention to construct an intake duct for an internal-combustion engine in such a manner that the flow rate of the gas flow takes into account the resistance caused by the inlet valve with the aim toward better operating characteristics of the internal-combustion engine.

This object is achieved by means of an arrangement wherein the intake duct is divided into a first duct section in the intake system and a second duct section of the cylinder head disposed downstream of the first duct section, said intake duct being provided with a defined flow profile which, until it reaches a cross-sectional transition are situated relatively close in front of the valve stem, has a uniform cross-sectional contraction and, behind it, has a uniform cross-sectional widening.

The principal advantages achieved by means of the invention are that the gas flow in the two duct sections of the suction pipe system and the cylinder head has an optimized flow rate course, whereby the gas flow is accelerated to the cross-sectional transition area and is decelerated behind it. The latter causes a reduction of the flow resistance, whereby the degree of delivery of the internal combustion engine is improved. This, in turn, increases the output and reduces the consumption.

Reference is also made to related, commonly assigned U.S. patent application Ser. No. 07/554,895, filed July 20, 1990, based on German patent application P 39 24 543.8 filed in Germany on July 25, 1989.

Other objects, advantages and novel features of the present invention will become apparent from the following detailed description of the invention when considered in conjunction with the accompanying drawings.

DETAILED DESCRIPTION OF THE DRAWING

Figure 1:
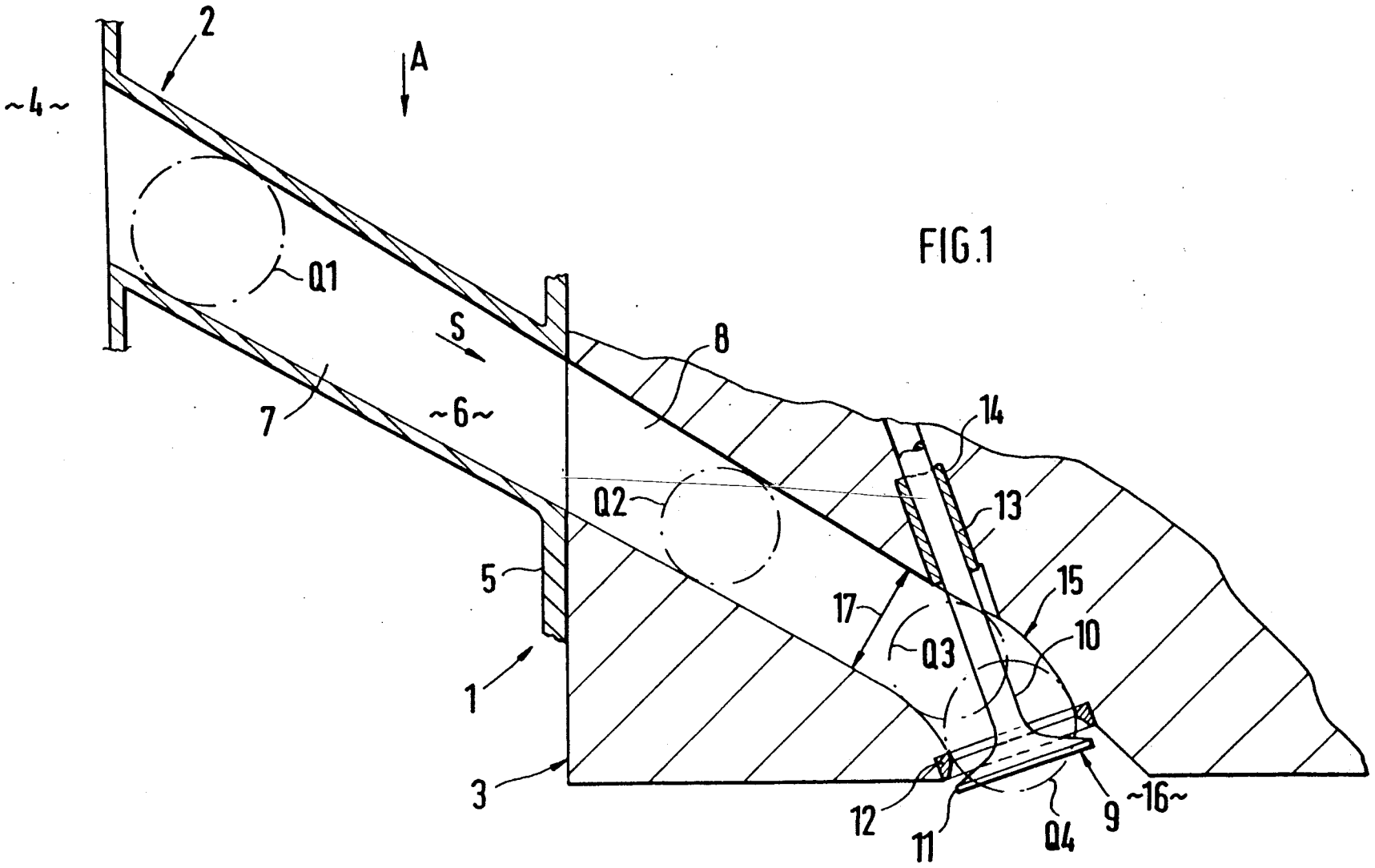
FIG. 1 is a schematic partial cross-sectional view of an internal combustion engine in the area of an intake system and of a cylinder head, constructed according to a preferred embodiment of the invention.

In the shown area, the internal-combustion engine comprises an intake system 2 and a cylinder head 3. At reference number 4, the intake system 2 is provided with a collector which is not shown in detail and connects to the cylinder head 3 by means of a fastening flange 5. An intake duct 6 extends between the intake system 2 and the cylinder head 3, this intake duct 6 being divided into a first duct section 7—length approximately 100 to 120 mm—in the intake system 2 and a second duct section 8 in the cylinder head 3.

A valve 9 which is actuated by a camshaft which is not shown is provided at the end of the intake duct 6. Valve 9 has a valve stem 10 and a valve disk 11; the valve disk cooperates with a valve seat 12. The valve stem 10 is arranged in a valve stem guide in an axially movable manner, this valve stem guide, in turn, resting in a bore 14 in the cylinder head 3. Locally, specifically in the area of a bend 15 of duct section 8, the valve stem 10 is subjected to a gas flow which is controlled by a valve 9. When the valve 9 is opened up, the gas flow arrives in a combustion space 16.

The intake duct 6 with the circular cross-section has the following flow profile: Its cross-section tapers uniformly conically along an essential partial length of the intake duct 6, specifically downstream—flow direction S—to a cross-sectional transition area 17 which—viewed in the flow direction S—is situated relatively closely in front of the valve stem 10.

Behind the cross-sectional transition area 17, the intake duct 6 also widens uniformly and conically. The cross-sectional tapering is defined by $Q1>Q2$, and the cross-sectional widening is defined by $Q3<Q4$. The cross-sectional widening $Q1>Q2$, according to the type and size of the internal-combustion engine, amounts to between 18 and 24%.

Figure 2:
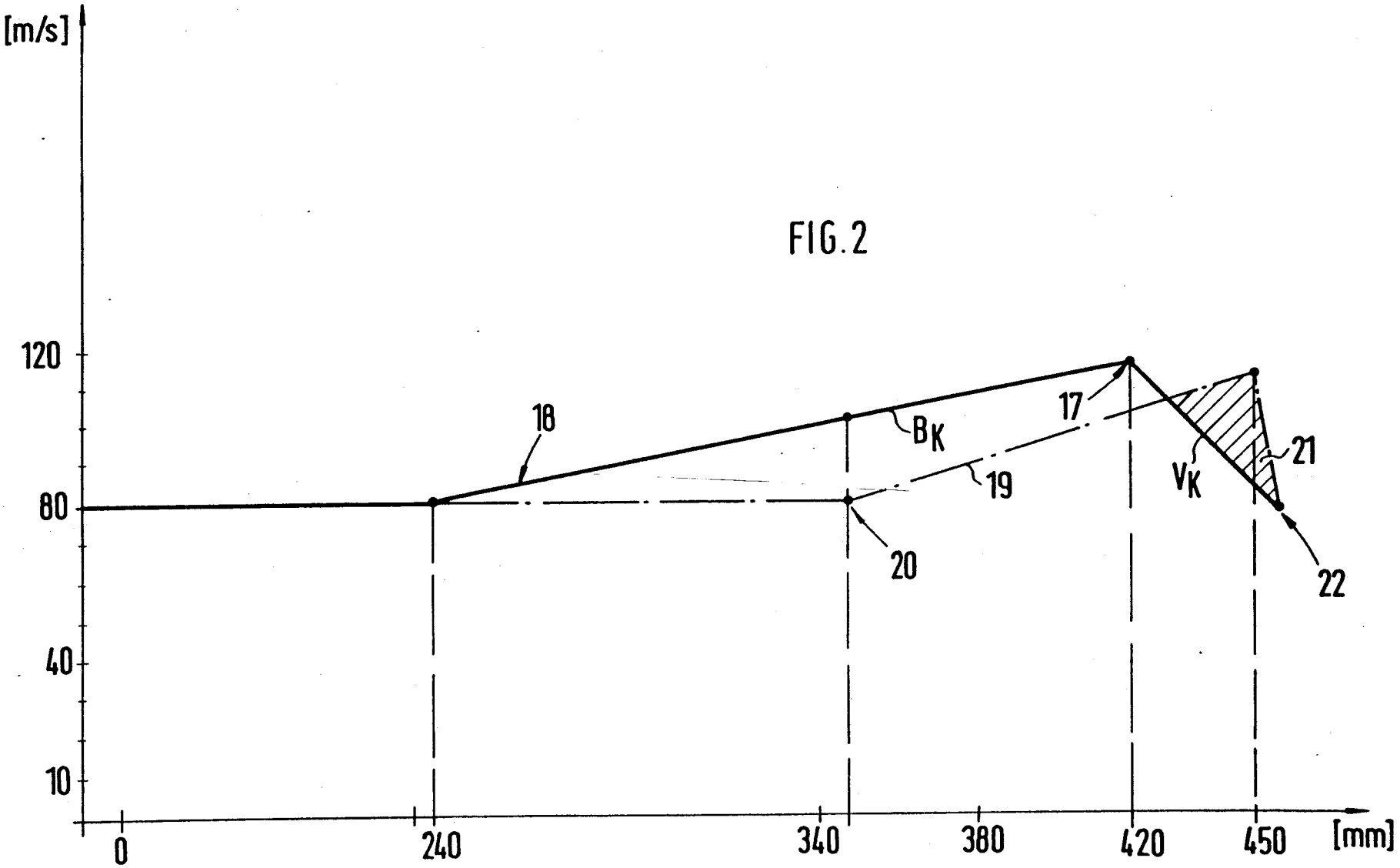
FIG. 2 is a diagram comparing the course of the flow rate of a gas flow in an intake system according to the prior art and according to the present invention.

According to FIG. 2, the course of the flow rate of the gas flow in the intake duct 6 is shown. In this case, the rate in m/s is entered on the ordinate, and the length of the intake duct in mm is entered on the abscissa. The drawn out line 18 represents the continuous bend-free acceleration $B_K$ to the cross-sectional transition area 17 and behind it the continuous delay $V_K$ of the gas flow. The dash dotted line 19 represents the course of the flow rate of the gas flow according to the state of the art. This comparison shows that line 19 has a bend 20 in the flow profile, and the gas flow is accelerated to shortly before the narrowest cross-section in the area of the valve seat ring. The hatched triangle 21 represents the reduction of the flow resistance. At 22, the gas flow has valve splitting velocity.

Figure 3:
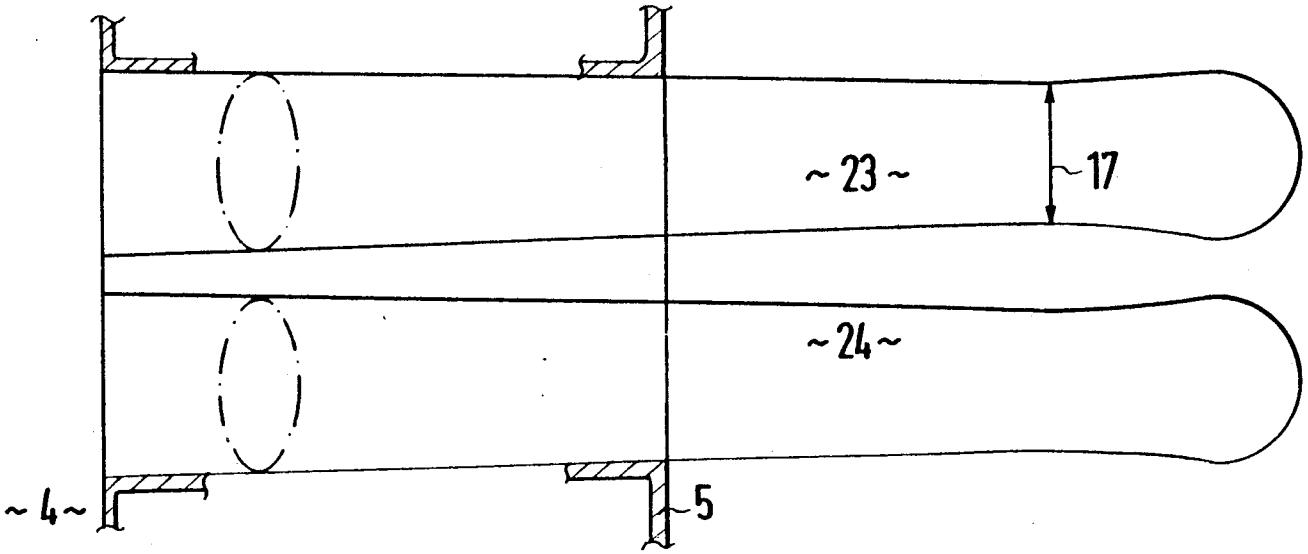
FIG. 3 is a schematic view taken in the direction of the arrow A of FIG. 1.

FIG. 3 shows two intake ducts 23, 24 extending in parallel to one another. Along their whole length, both intake ducts 23, 24 are constructed to be conical and essentially separate from one another. In addition, they have flow profiles which, in principle, are identical. This construction is suitable for an internal-combustion engine with at least two inlet valves per cylinder which are arranged in the cylinder head and are actuated, for example, by means of two camshafts.

Figure 4:
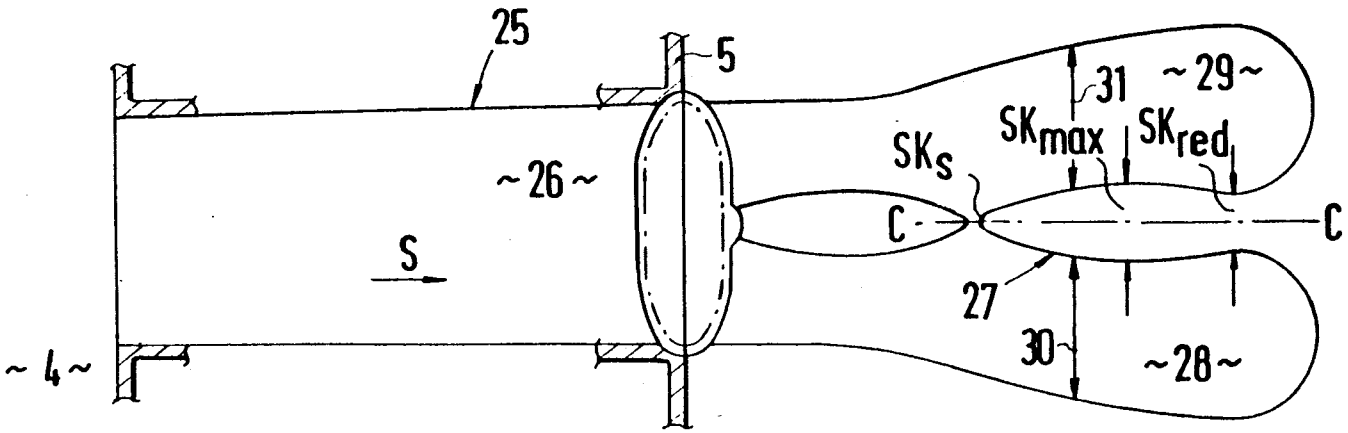
FIG. 4 is a view corresponding to FIG. 3 of another embodiment of the invention.

FIG. 4 also shows an intake duct 25 for an internal-combustion engine with two inlet valves per cylinder. The intake duct 25 has a tendency to have a flow profile as shown in FIG. 2. However, viewed in the flow direction S, it is at first a single duct 26 which then, by means of a partition 27, is divided into two separate duct areas 28, 29 which, having a bifurcated shape, lead to the inlet valves. The partition 27 starts downstream—flow direction S—in front of the valve stem 10 and is constructed as a type of flow body with a symmetrically streamlined profile. It starts with a rounded point $SK_S$ which is opposed to the gas flow and expands continuously on both sides of a transverse center plane C-C to a maximal width $SK_{max}$, from where the profile tapers to a reduced width $SK_{red}$. The flow body, specifically the interrelationships $SK_{max}$ and $SK_{red}$, may be defined empirically and/or mathematically while taking into account constructional circumstances and minimal friction and pressure losses. Finally, in the case of this construction of the intake duct, cross-sectional transition areas 30, 31 are provided in the duct areas 28, 29. The gas flow is accelerated until it reaches the cross-sectional transition areas 30, 31 which are situated downstream—flow direction S—relatively shortly in front of the valve stem, and is then decelerated. The latter is achieved by means of the uniform cross-sectional widening of the duct areas 28, 29 behind these cross-sectional transition areas.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A flow duct, particularly an intake duct, in an intake system and a cylinder head of an internal-combustion engine, in which a gas flow is controlled by means of a valve which comprises a valve disk interacting with a valve seat and a valve stem having a longitudinal axis which is connected with the valve seat and, in an axially movable manner, is disposed in a valve stem guide, the valve stem being arranged adjacent to the valve seat ring in the intake duct in such a manner that it is subjected to the gas flow, wherein the intake duct is divided into a first, contracting duct section in the intake system and a second, widening duct section in the cylinder head, said intake duct extending in a linear non-offset manner from a plane including the valve stem axis and being provided with a defined flow profile which, until it reaches a cross-sectional transition area situated relatively close and upstream of the valve stem, has a uniform cross-sectional contraction and, downstream of said contraction, has a uniform cross-sectional widening.

2. A flow duct according to claim 1, wherein the cross-sectional contraction of the intake duct to the cross-sectional transition area is conical.

3. A flow duct according to claim 2, wherein the cross-sectional contraction of the area is between 18% and 24%.

4. A flow duct according to claim 1, wherein the cylinder head of the engine comprises at least two inlet valves per cylinder which control the gas flow in respective separate intake ducts between the intake system and the cylinder head, and wherein the intake ducts of each cylinder in principle have identical flow profiles.

5. A flow duct according to claim 1, wherein the cylinder head of the engine comprises at least two inlet valves per cylinder which control the gas flow in the intake duct between the intake system and the cylinder head, wherein in the flow direction S, the intake duct at first is a single duct and then is divided into two separate duct areas by means of a partition starting in front of the valve stem, and wherein the flow profile extends along the single duct and the two separate duct areas.

6. A flow duct according to claim 5, wherein the partition between the duct areas is constructed as a flow body with a symmetrically streamlined profile.

7. A flow duct according to claim 6, wherein the flow body, starting from a rounded tip ($SK_S$) opposing the gas flow, expands along a first body section ($SK_1$), to which a second tapering body section ($SK_2$) connects.

8. A process for influencing the flow rate of the gas flow in a flow duct particularly an intake duct, in an intake system and a cylinder head of an internal-combustion engine, in which a gas flow is controlled by means of a valve which comprises a valve disk interacting with a valve seat and a valve stem having a longitudinal axis which is connected with the valve seat and, in an axially movable manner, is disposed in a valve stem guide, the valve stem being arranged adjacent to a valve seat ring in the intake duct in such a manner that it is subjected to the gas flow, wherein the intake duct is divided into a first, contracting duct section in the intake system and a second, widening duct section in the cylinder head disposed downstream of the first duct section, said intake duct extending in a linear non-offset manner from a plane including the valve stem axis and being provided with a defined flow profile which, until it reaches a cross-sectional transition area situated relatively close and upstream of the valve stem, has a uniform cross-sectional contraction and, downstream of the contraction, has a uniform cross-sectional widening, and wherein the flow rate of the gas flow in the first duct section and in the second duct section is increased continuously until reaching the cross-sectional transition area and after that is continuously reduced.

9. A process for manufacturing a flow duct, particularly an intake duct, in an intake system and a cylinder head of an internal-combustion engine, in which a gas flow is controlled by means of a valve which comprises a valve disk interacting with a valve seat and a valve stem having a longitudinal axis which is connected with the valve seat and, in an axially movable manner, is disposed in a valve stem guide, the valve stem being arranged adjacent to a valve seat ring in the intake duct in such a manner that it is subjected to the gas flow, wherein the intake duct is divided into a first, contracting duct section in the intake system and a second, widening duct section in the cylinder head disposed downstream of the first duct section, said intake duct extending in a linear non-offset manner from a plane including the valve stem and being provided with a defined flow profile which, until it reaches a cross-sectional transition area situated relatively close and upstream of the valve stem, has a uniform cross-sectional contraction and, downstream of said contraction, has a uniform cross-sectional widening.

* * * * *